US011421505B2

(12) United States Patent
Pelto et al.

(10) Patent No.: US 11,421,505 B2
(45) Date of Patent: Aug. 23, 2022

(54) WELLBORE PACKER WITH EXPANDABLE METAL ELEMENTS

(71) Applicant: Halliburton Energy Services, Inc., Houston, TX (US)

(72) Inventors: Christopher Michael Pelto, Garland, TX (US); Michael Linley Fripp, Carrollton, TX (US); Geir Gjelstad, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/124,015

(22) Filed: Dec. 16, 2020

(65) Prior Publication Data

US 2022/0186579 A1 Jun. 16, 2022

(51) Int. Cl.

| | |
|---|---|
| ***E21B 33/127*** | (2006.01) |
| ***E21B 23/06*** | (2006.01) |
| ***E21B 33/12*** | (2006.01) |

(52) U.S. Cl.

CPC ..... *E21B 33/127* (2013.01); *E21B 23/06* (2013.01); *E21B 33/12* (2013.01); *E21B 33/1208* (2013.01)

(58) Field of Classification Search

CPC .... E21B 33/127; E21B 23/06; E21B 33/1208; E21B 33/12

See application file for complete search history.

(56) References Cited

U.S. PATENT DOCUMENTS

| | | | | |
|---|---|---|---|---|
| 6,609,567 | B2 * | 8/2003 | Ingram | E21B 17/06 166/126 |
| 7,040,404 | B2 | 5/2006 | Brothers et al. | |
| 7,578,347 | B2 | 8/2009 | Bosma et al. | |
| 2003/0150614 | A1 | 8/2003 | Brown et al. | |
| 2011/0186307 | A1 | 8/2011 | Derby | |
| 2015/0021030 | A1 | 1/2015 | Loginov et al. | |
| 2016/0230495 | A1 | 8/2016 | Mazyar et al. | |

(Continued)

FOREIGN PATENT DOCUMENTS

| | | |
|---|---|---|
| EP | 2258920 | 12/2010 |
| WO | 2016036371 | 3/2016 |
| WO | 2019094044 | 5/2019 |

(Continued)

OTHER PUBLICATIONS

Application No. PCT/US2020/066098 , International Search Report and Written Opinion, dated Sep. 8, 2021, 13 pages.

*Primary Examiner* — Yong-Suk (Philip) Ro
(74) *Attorney, Agent, or Firm* — Kilpatrick Townsend & Stockton LLP

(57) ABSTRACT

A wellbore packer system includes a mandrel positionable within a wellbore. The system further includes a wellbore packer positionable around the mandrel. The wellbore packer includes an expandable metal sealing element positionable around a first portion of the mandrel to form a long-term seal within the wellbore in response to exposure of the expandable metal sealing element to wellbore fluid. Additionally, the wellbore packer includes an elastomeric sealing element positionable around a second portion of the mandrel to form a short-term seal in response to receiving a seal-setting force. Moreover, the wellbore packer includes a setting piston positionable to apply the seal-setting force on the elastomeric sealing element.

20 Claims, 5 Drawing Sheets

(56) References Cited

U.S. PATENT DOCUMENTS

2021/0332659 A1* 10/2021 Fripp ..... E21B 33/1208

FOREIGN PATENT DOCUMENTS

| | | |
|---|---|---|
| WO | 2019164492 | 8/2019 |
| WO | 2019164499 | 8/2019 |
| WO | 2020018110 | 1/2020 |
| WO | 2020068037 | 4/2020 |
| WO | 2020171825 | 8/2020 |

* cited by examiner

WELLBORE PACKER WITH EXPANDABLE METAL ELEMENTS

TECHNICAL FIELD

The present disclosure relates generally to wellbore operations and, more particularly (although not necessarily exclusively), to a packer deployable within a wellbore.

BACKGROUND

Packers may be used for, among other reasons, forming annular seals in and around conduits in wellbore environments. The packers may be used to form these annular seals in both open and cased wellbores. The annular seals may restrict portions of fluid or pressure communication at a seal interface. Forming seals may be part of wellbore operations at stages of drilling, completion, or production. The packers may be used for zonal isolation in which a zone or zones of a subterranean formation may be isolated from other zones of the subterranean formation or other subterranean formations. One use of packers may be to isolate any of a variety of inflow control devices, screens, or other such downhole tools that may be used in wellbores. Some materials used for sealing may rely on precision machining to ensure that surface contact at an interface of the sealing material is optimal. Thus, materials that do not have a preferred surface finish, for example, rough or irregular surfaces having gaps, bumps, or any other profile variance, may not be sufficiently sealed by these materials that rely on the precision machining.

DETAILED DESCRIPTION

Figure 1:
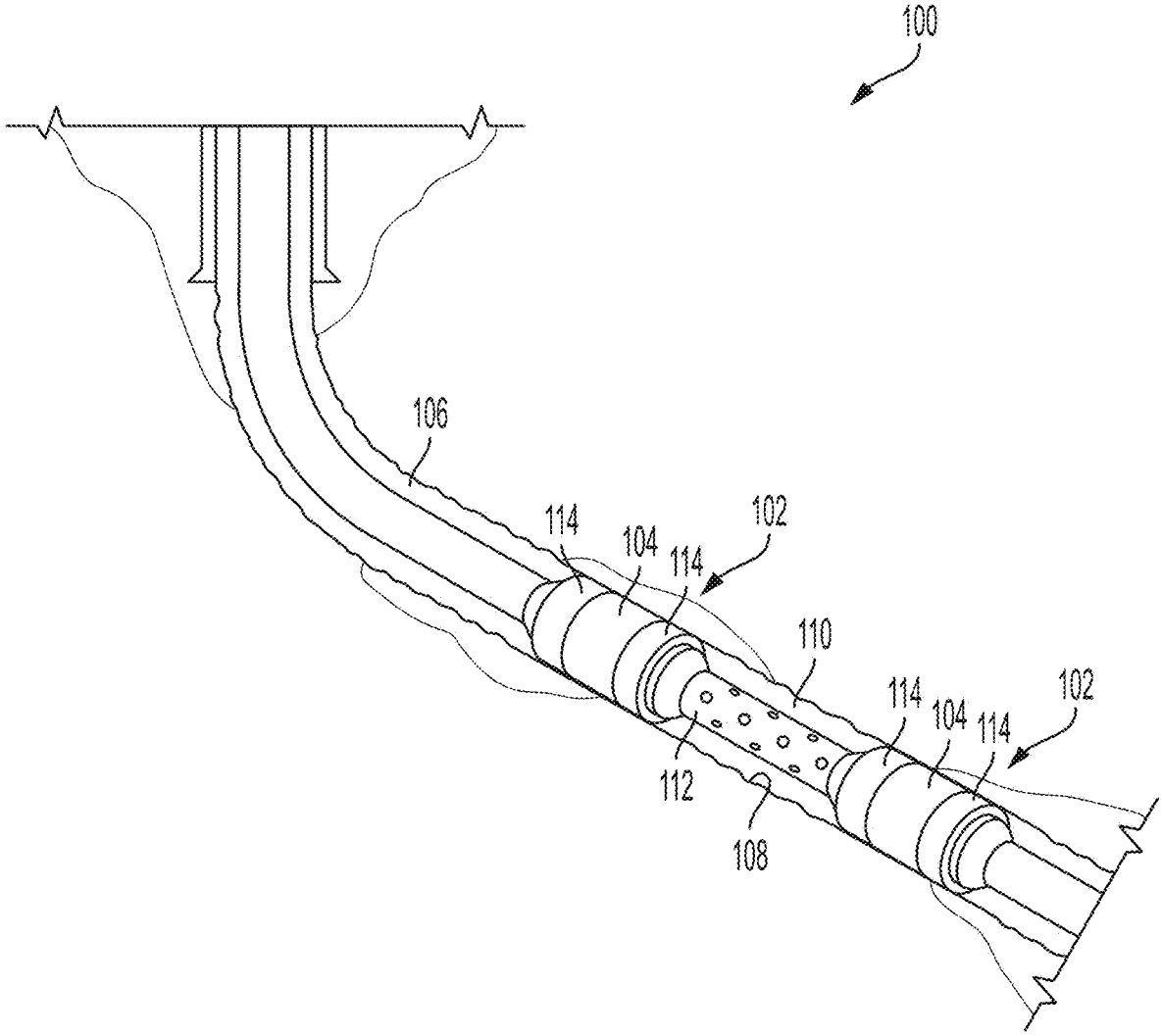
FIG. 1 is a schematic of a set of swell packers having an expandable metal material disposed in a wellbore, according to one example of the present disclosure.

Certain aspects and examples of the present disclosure relate to forming a long-term seal in a wellbore with a packer system that includes an expandable metal sealing element and an elastomeric sealing element. The packer system may be deployed in a wellbore for isolating zones within a wellbore during downhole operations. An example of the downhole operations may be hydraulic fracturing. The expandable metal sealing element may be made from an expandable metal material, such as magnesium, aluminum, calcium, or any other suitable metal for forming the long-term seal. The expandable metal material may form the long-term seal subsequent to undergoing a hydrolysis reaction with a brine injected into the wellbore. The hydrolysis reaction may involve an alkaline earth metal, a transition metal, or both. The long-term seal may be stable for a sufficient amount of time to complete downhole operations of the wellbore. In some examples, the long-term seal may be stable for an entire life of the wellbore.

During a setting or swelling process of a swellable metal packer, the expandable metal material may form loose particles that may lock together when in compression to form a rigid structure that is able to seal zones within the wellbore. If there is high crossflow of wellbore fluid across the expandable metal material during this swelling process, there may be a risk that the loose particles are flushed downhole, and the expandable metal material may not be able to form the seal. The presently described packing system may include elements that retain the loose particles or eliminate or reduce the crossflow across the swellable metal material during the setting process. The packing system may also expand the use of a packer in a well that may encounter long-term elastomeric deterioration effects. In some wells, elastomeric material may be practical for short-term applications but would suffer from ongoing deterioration effects due to chemical exposure or temperature effects. These deterioration effects may include elastomeric hardening (reducing sealing capacity) or reduced density (due to chemical dissolution).

Elastomeric sealing elements may be disposed on either side of the expandable metal sealing element in the packing system to retain the loose particles of the expandable metal material during a setting operation. A seal-setting force may be applied using a setting chamber that applies an increase in pressure to a setting piston. The setting chamber may provide an axial load on the elastomeric sealing elements that causes the elastomeric sealing elements to expand outward and provide a short-term seal. In some examples, the setting chamber may be replaced with a hydrostatic piston in communication with an atmospheric or vacuum chamber. The expandable metal sealing element may be rigid and can transfer the axial setting loads and may act as a spacer between the elastomeric sealing elements. Body lock rings may include teeth on one side of the body lock rings for retaining a seal-setting force within the elastomeric sealing elements even after the axial load from the setting chamber is removed. Over time, the expandable metal material of the expandable metal sealing element may react to surrounding fluids and expand to create a long-term seal.

The packer system may include the expandable metal sealing element, a setting piston, the elastomeric sealing element, and a mandrel. The expandable metal sealing element, the setting piston, and the elastomeric sealing element may be positioned on the mandrel, and the mandrel may be positioned downhole for deploying the packing system to form the long-term seal. The mandrel may additionally include the setting chamber that engages or otherwise causes the setting piston to apply the seal-setting force. The setting piston may apply the seal-setting force to the elastomeric setting element that may cause the elastomeric sealing element to form the short-term seal. In response to forming the short-term seal, the setting piston may maintain the seal-setting force for a predetermined amount of time. In some examples, upon forming the short-term seal, the setting piston may release the seal-setting force, and the body lock ring positioned on the mandrel may retain the seal-setting force indefinitely. During the time in which the seal-setting force is applied to the system, the elastomeric sealing element may not extrude or otherwise degrade.

In forming the short-term seal, the hydrolysis reaction and subsequently the dehydration reaction of the expandable metal element may be initialized. The combination of the hydrolysis reaction and the subsequent dehydration reaction may be referred to collectively as "the reactions." The reactions may result from exposure of the expandable metal material of the expandable metal sealing element to chemicals within the wellbore that may cause the expandable metal material to form the long-term seal. The reactions may last a predetermined amount of time, and this predetermined amount of time may be shorter than the predetermined amount of time that the short-term seal is retained. For example, if the short-term seal is retained for about one week, the reactions may be completed in a time that is less than one week. Upon completion of the reactions, the expandable metal element may have formed a long-term seal, and the long-term seal may persist for the life of the downhole operations. In some examples, the long-term seal may be permanent.

In some examples, the packing system may include two elastomeric sealing elements that are each disposed on a different side of the expandable metal sealing element. In other examples, the packing system may include two expandable metal sealing elements, each disposed on a different side of the elastomeric sealing element. In other examples, the packing system may include one elastomeric sealing element disposed on one side of the expandable metal sealing element. In yet other examples, the packing system may include two setting pistons positioned on the mandrel to provide an axial load on the elastomeric sealing elements in opposite directions. In such an example, there may be any suitable combination of elastomeric sealing elements and expandable metal sealing elements. In any of the aforementioned examples, the packing system may be able to form the long-term seal in the wellbore. Any other suitable arrangement of the packing system may also be used for forming the long-term seal.

The expandable metal material of the expandable metal sealing elements may swell by undergoing hydrolysis reactions in the presence of brines to form metal hydroxides. The metal hydroxide may occupy more space than the base metal reactant. This expansion in volume may allow the expandable metal material to form the long-term seal at the interface of the expandable metal material and any adjacent surfaces. For example, a mole of magnesium has a molar mass of 24 g/mol and a density of 1.74 g/cm$^3$ which results in a volume of 13.8 cm/mol. Magnesium hydroxide has a molar mass of 60 g/mol and a density of 2.34 g/cm$^3$ which results in a volume of 25.6 cm/mol. 25.6 cm/mol is 85% more volume than 13.8 cm/mol. As another example, a mole of calcium has a molar mass of 40 g/mol and a density of 1.54 g/cm$^3$ which results in a volume of 26.0 cm/mol. Calcium hydroxide has a molar mass of 76 g/mol and a density of 2.21 g/cm$^3$ which results in a volume of 34.4 cm/mol. 34.4 cm/mol is 32% more volume than 26.0 cm/mol. As yet another example, a mole of aluminum has a molar mass of 27 g/mol and a density of 2.7 g/cm$^3$ which results in a volume of 10.0 cm/mol. Aluminum hydroxide has a molar mass of 63 g/mol and a density of 2.42 g/cm$^3$ which results in a volume of 26 cm/mol. 26 cm/mol is 160% more volume than 10 cm/mol.

The expandable metal material may include any metal or metal alloy that may undergo a hydration reaction to form a metal hydroxide of greater volume than the base metal or metal alloy reactant. The metal may become separate particles during the hydration reaction and these separate particles may lock or bond together to form what is considered the expandable metal material. Examples of suitable metals for the expandable metal material include, but are not limited to, magnesium, calcium, aluminum, tin, zinc, beryllium, barium, manganese, or any combination thereof. Examples of suitable metal alloys for the expandable metal material may include, but are not limited to, any alloys of magnesium, calcium, aluminum, tin, zinc, beryllium, barium, manganese, or any combination thereof. Specific examples of the metal alloys can include magnesium-zinc, magnesium-aluminum, calcium-magnesium, or aluminum-copper.

In some examples, the metal alloys may include alloyed elements that are not metallic. Examples of these nonmetallic elements include, but are not limited to, graphite, carbon, silicon, boron nitride, and the like. In some examples, the metal may be alloyed to increase reactivity or to control the formation of oxides. In some examples, the metal alloy may be alloyed with a dopant metal that promotes corrosion or inhibits passivation and thus increases hydroxide formation. Examples of dopant metals include, but are not limited to nickel, iron, copper, carbon, titanium, gallium, mercury, cobalt, iridium, gold, palladium, or any combination thereof.

In examples in which the expandable metal material comprises a metal alloy, the metal alloy may be produced from a solid solution process or a powder metallurgical process. The sealing element comprising the metal alloy may be formed either from the metal alloy production process or through subsequent processing of the metal alloy. As used herein, the term "solid solution" refers to an alloy that is formed from a single melt in which the components in the alloy, such as a magnesium alloy, are melted together in a casting. The casting can be subsequently extruded, wrought, hipped, or worked to form a desired shape for the sealing element of the expandable metal material. It is to be understood that some minor variations in the distribution of the alloying particles can occur.

A solid solution may be a solid-state solution of one or more solutes in a solvent. Such a mixture may be considered a solution rather than a compound when a crystal structure of the solvent remains unchanged by addition of the solutes and when the mixture remains in a single homogeneous phase. A powder metallurgy process generally includes obtaining or producing a fusible alloy matrix in a powdered form. The powdered fusible alloy matrix is then placed in a mold or blended with at least one other type of particle and then placed into a mold. Pressure may be applied to the mold to compact the powder particles together to fuse them to form a solid material, which may be used as the expandable metal material. In some examples, the expandable metal material may include an oxide. As an example, calcium oxide reacts with water in an energetic reaction to produce calcium hydroxide. One mole of calcium oxide occupies 9.5 cm$^3$ whereas 1 mole of calcium hydroxide occupies 34.4 cm$^3$, which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof. The selected expandable metal material may be selected such that the formed sealing element does not degrade into the brine. As such, the use of metals or metal alloys for the expandable metal material that form relatively water-insoluble hydration products may be preferred. For example, magnesium hydroxide and calcium hydroxide have low solubility in water.

Additionally, the sealing element may be positioned in the downhole tool such that degradation into the brine may be constrained due to the geometry of the area in which the sealing element is disposed and thus resulting in reduced exposure of the sealing element. For example, the volume of the area in which the expandable metal sealing element is disposed may be less than the expansion volume of the expandable metal material. In some examples, the volume of the area is less than as much as 50% of the expansion volume. Alternatively, the volume of the area in which the sealing element may be disposed may be less than 90% of the expansion volume, less than 80% of the expansion volume, less than 70% of the expansion volume, or less than 60% of the expansion volume.

In some examples, the metal hydration reaction may include an intermediate step in which the metal hydroxides are small particles. When confined, these small particles may lock together to create the seal. Thus, there may be an intermediate step where the expandable metal material forms a series of fine particles between the steps of being solid metal and forming a seal. The small particles may have a maximum dimension less than 0.1 inch and generally have a maximum dimension less than 0.01 inches. In some examples, the small particles include between one and 100 grains (metallurgical grains).

In some examples, the expandable metal material of the expandable metal sealing elements may be dispersed into a binder material. The binder may be degradable or non-degradable. In some examples, the binder may be hydrolytically degradable. The binder may be expandable or non-expandable. If the binder is expandable, the binder may be oil-expandable, water-expandable, or oil- and water-expandable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycobc acid, nitrile rubber, isoprene rubber, PTFE, silicone, fluroelastomers, ethylene-based rubber, and PEEK. In some embodiments, the dispersed swellable metal may be cuttings obtained from a machining process. In some examples, the metal hydroxide formed from the expandable metal material may be dehydrated under sufficient expanding pressure. For example, if the metal hydroxide resists movement from additional hydroxide formation, elevated pressure may be created which may dehydrate the metal hydroxide. This dehydration may result in the formation of the metal oxide from the expandable metal. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the expandable metal material may allow the expandable metal material to form additional metal hydroxide and continue to expand.

In an example, the brine used to form the metal hydroxides within the wellbore may be saltwater (e.g., water containing one or more salts dissolved therein), saturated saltwater (e.g., saltwater produced from a subterranean formation), seawater, fresh water, or any combination thereof. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines can include, for example, magnesium chloride brines, calcium chloride brines, calcium bromide brines, and the like. In some examples, the salinity of the brine may exceed 10%.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic 100 of a set of swell packers 102 having at least one expandable metal sealing element 104 disposed in a wellbore 106, according to one example of the present disclosure. At a desired setting depth, the swell packer 102 is exposed to a brine, and the expandable metal sealing element 104, which may be made from the expandable metal material described above, swells to contact an adjacent wellbore wall 108 to form an annular seal. In the illustrated example, multiple swell packers 102 are illustrated. As the multiple swell packers 102 seal the wellbore 106, portions 110 of wellbore 106 between the seals may be isolated from other portions of wellbore 106. Although the isolated portion 110 of wellbore 106 is illustrated as uncased or an open hole, it may be understood that the swell packer 102 may be used in any cased portion of the wellbore 106 to form an annular seal in the annulus between a conduit 112 and a cement sheath (not shown). Further, the swell packer 102 may also be used to form an annular seal between two distinct conduits 112 in other examples. Although FIG. 1 illustrates the use of two swell packer 102, it is to be understood that any swell packer or combination of swell packers disclosed herein may be used in any of the examples disclosed herein.

In an example, the swell packers 102 may include elastomeric sealing elements 114. Each of the swell packers 102 are depicted as having two elastomeric sealing elements 114, but any suitable number of elastomeric sealing elements 114 may be positioned at the swell packer 102 for forming a short-term seal while the expandable metal sealing element 104 undergoes a swelling reaction. The elastomeric sealing elements 114 may be disposed on either side of the expandable metal sealing element 104 and may form the short-term seal in response to receiving a seal-setting force from a setting piston positioned on the swell packer 102, as discussed in further detail below with respect to FIG. 2. The elastomeric sealing elements 114 may not extrude and may remain in a sealing contact with the wellbore wall 108 or casing while the expandable metal sealing element 104 forms the long-term seal using a hydrolysis reaction or a hydrolysis reaction followed by a dehydration reaction.

Figure 2:
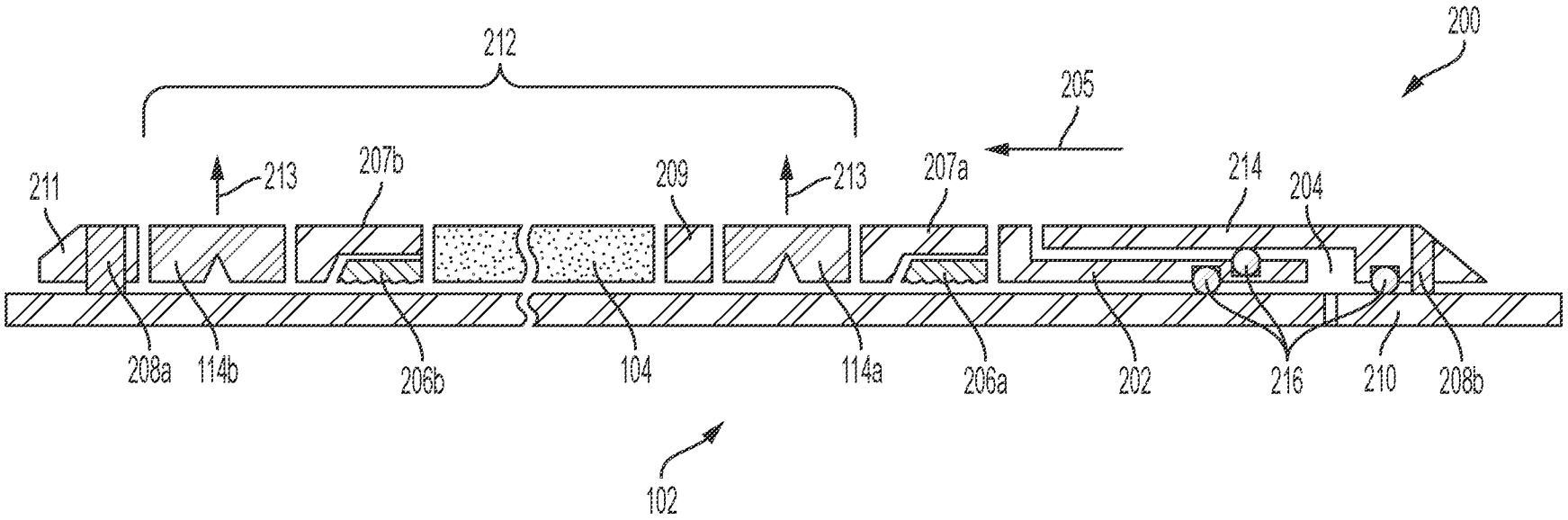
FIG. 2 is a sectional view of an example of the swell packer of FIG. 1, according to one example of the present disclosure.

FIG. 2 is a sectional view 200 of an example of the swell packer 102 according to one example of the present disclosure. The swell packer 102 may include two elastomeric sealing elements 114*a* and 114*b* and the expandable metal sealing element 104 positioned around a mandrel 210. In an example a setting piston 202 may be actuated by a setting chamber 204 to apply an axial load in a direction 205 on a body lock ring 206*a* and an element retainer 207*a*. In an example, the axial load may be transmitted from the element retainer 207*a* on the elastomeric sealing element 114*a*, which in turn transmits the axial load to an element support ring 209, the expandable metal sealing element 104, an element retainer 207*b* and a body lock ring 206*b*, and the elastomeric sealing element 114*b*.

The elastomeric sealing element 114*b* may be compressed between the element retainer 207*b* and an end ring 211, which is held stationary by a set screw 208*a*. The compression on the elastomeric sealing elements 114*a* and 114*b* by the axial load may cause the elastomeric sealing elements 114*a* and 114*b* to compress and expand in a direction 213 to create a short-term seal between the mandrel 210 and the wall 108 of the wellbore 106. In an example, the elastomeric sealing elements 114 may be any polymer-based material, rubber-based material, or any other suitable material for receiving a seal-setting force, such as the axial load, from the setting piston 202 to expand to form the short-term seal. After the short-term seals are set at the elastomeric sealing elements 114*a* and 114*b*, the expandable metal sealing element 104 may undergo a chemical reaction to expand in the direction 213 to create a long-term seal between the mandrel 210 and the wall 108 of the wellbore 106. The swell packer 102 may include any other suitable components that enable the swell packer 102 to form a long-term seal in the wellbore 106.

The elastomeric sealing elements 114, the expandable metal sealing element 104, the setting piston 202, the setting chamber 204, the body lock rings 206, and the set screws 208 may be positioned around the mandrel 210, and the mandrel 210 may be a section of tubing that receives the components of the swell packer 102 and enables a flow of fluid through a central portion of the swell packer 102. The set screws 208 may hold in place any components of the swell packer 102 that are positioned on the mandrel 210 and maintained in a stationary position with respect to the mandrel 210. For example, the set screw 208*a* maintains the end ring 211 in a stationary position with respect to the mandrel 210, and a set screw 208*b* maintains a setting cylinder 214 in a stationary position with respect to the mandrel 210.

The setting chamber 204 may be a fluid volume between the mandrel and the setting cylinder 214. In an example, the pressure within the mandrel 210, as controlled from a surface of the wellbore 106, may increase a pressure within the setting chamber 204 to drive the setting piston 202 to apply the axial load as a seal-setting force on the elastomeric sealing elements 114. A set of o-ring type seals 216 may prevent fluid from leaking out of the setting chamber 204. In some examples, the setting chamber 204 may be a vacuum chamber with a shear screw that shears when a specified amount of force is applied to the shear screw. In such an example, the setting piston 202 applies the seal-setting force on the elastomeric sealing elements 114 when the shear screw is sheared.

In response to receiving the seal-setting force from the setting piston 202, the elastomeric sealing elements 114 may form the short-term seal. In forming the short-term seal, the elastomeric sealing elements 114 may not extrude. In an example, the elastomeric sealing elements 114 may generate a 2000-5000 PSI seal. Subsequent to the setting piston 202 applying the seal-setting force and the elastomeric sealing elements 114 forming the short-term seal, the body lock rings 206 may retain the seal-setting force. For example, the body lock rings 206 may only be movable in the direction 205, and the body lock rings 206 may bite into the mandrel 210 to prevent movement in a direction opposite the direction 205. In an example, the body lock rings 206 may move in the direction 205 as part of a ratcheting system. The body lock rings 206 may retain the seal-setting force on the elastomeric sealing elements 114 for any suitable amount of time for completing the setting of the long-term seal. The short-term seal and the long-term seal may be formed in a sealing region 212.

While the body lock rings 206 retain the short-term seal applied to the elastomeric sealing elements 114 by the setting piston 202, the long-term seal may be formed by the expandable metal sealing element 104. Upon the setting piston 202 applying the seal-setting force, the expandable metal sealing element 104 may undergo the hydrolysis reaction. The hydrolysis reaction may involve an alkaline earth metal, a transition metal, or both. The hydrolysis reaction may be followed by a dehydration reaction, the dehydration reaction also involving the alkaline earth metal, the transition metal, or both. Because the chemical reactions occurring at the expandable metal sealing element 104 may produce heat that can impact the effectiveness of the elastomeric sealing element 114*a*, the element support ring 209 may be positioned between the elastomeric sealing element 114*a* and the expandable metal sealing element 104. The element support ring 209 may be stainless steel, ceramic, or any other composition suitable for use in a downhole environment.

Figure 3:
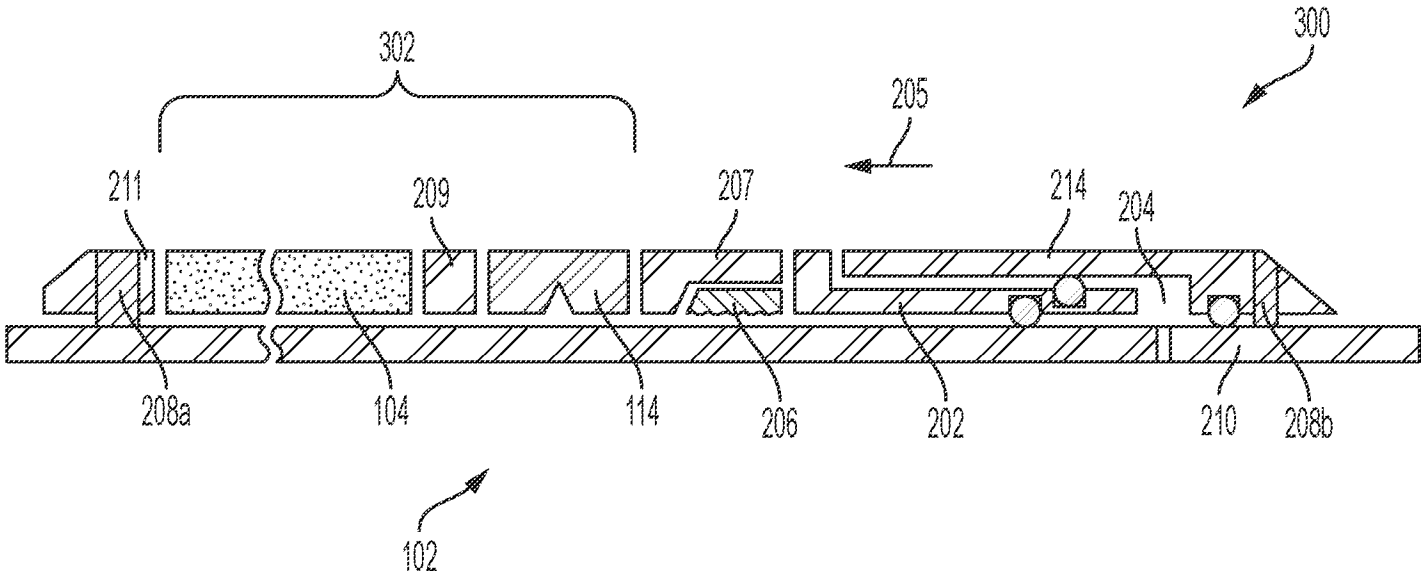
FIG. 3 is a sectional view of an additional example of the swell packer of FIG. 1, according to one example of the present disclosure.

FIG. 3 is a sectional view 300 of an additional example of the swell packer 102, according to one example of the present disclosure. The swell packer 102 in FIG. 3 may be similar to the swell packer 102 of FIG. 2, except the swell packer 102 in FIG. 3 includes a single elastomeric sealing element 114. Further, because there is only a single elastomeric sealing element 114, only a single body lock ring 206 and a single element retainer 207 are included. Other components of the swell packer 102 may be similar and may function similarly to those described above with respect to FIG. 2. The swell packer 102 may form the short-term seal when the setting piston 202 applies the seal-setting force in the direction 205 on the elastomeric sealing element 114. The elastomeric sealing element 114 may prevent a crossflow of wellbore fluid across the expandable metal material of the expandable metal sealing element 104 during the swelling process. By preventing the crossflow of wellbore fluid, a risk that loose particles of the expandable metal sealing element 104 will be flushed downhole during the swelling process may be reduced. The expandable metal sealing element 104 forms the long-term seal by way of the hydrolysis reaction or the hydrolysis reaction and a subsequent dehydration reaction. The sealing region 302 of the swell packer 102 may include the elastomeric sealing element 114 and the expandable metal sealing element 104. In an example, the elastomeric sealing element 114 may be positioned uphole or downhole from the expandable metal sealing element 104.

Figure 4:
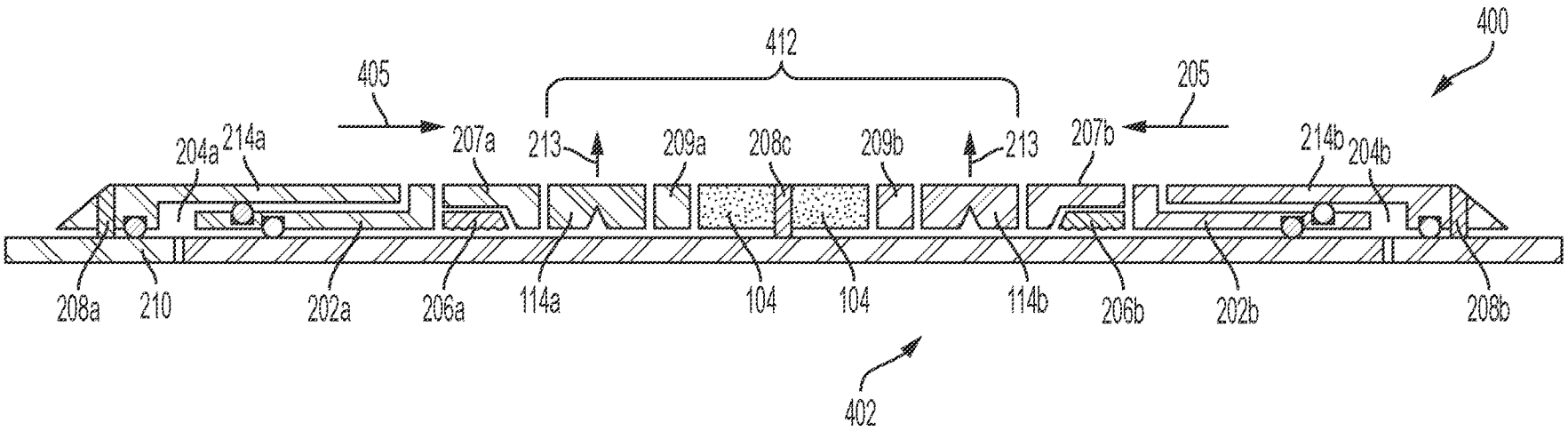
FIG. 4 is a sectional view of an example of a swell packer having two setting pistons, according to one example of the present disclosure.

FIG. 4 is a sectional view 400 of an example of a swell packer 402 having two setting pistons 202*a* and 202*b*, according to one example of the present disclosure. The swell packer 402 may include similar components to the swell packers 102 described above with respect to FIGS. 1-3, but the swell packer 402 includes the two setting pistons 202*a* and 202*b* positioned opposite of each other on the mandrel 210. Additionally, the swell packer 102 of FIG. 4 includes two setting chambers 204*a* and 204*b* and two setting cylinders 214*a* and 214*b*. The two setting pistons 202*a* and 202*b* may each operate in a manner similar to the piston 202 described above with respect to FIG. 2. For example, as the pressure in the setting chamber 204*a* increases, the setting piston 202*a* may exert a seal-setting force in a direction 405. Similarly, as the pressure in the setting chamber 204*b* increases, the setting piston 202*b* may exert a seal-setting force in the direction 205.

An additional set screw 208*c* may be positioned in a central portion of the expandable metal sealing element 104. The setting pistons 202*a* and 202*b* may respectively act on the elastomeric sealing elements 114*a* and 114*b* for applying the seal-setting force. The extra set screw 208*c* may maintain the expandable metal sealing element 104 in a stationary position with respect to the mandrel 104 while the elastomeric sealing elements 114*a* and 114*b* expand radially outward in the direction 213. The swell packer 402 may form the long-term seal by trapping a fluid, such as a brine, that reacts with the expandable metal sealing element 104 between the elastomeric sealing elements 114*a* and 114*b*. The reaction between the fluid and the expandable metal sealing element 104 may cause expansion of the expandable metal sealing element 104 in the direction 213 to create the long-term seal with the wall 108 of the wellbore 106. Because the chemical reactions occurring at the expandable metal sealing element 104 may produce heat that could impact the effectiveness of the elastomeric sealing elements 114*a* and 114*b*, the element support rings 209*a* and 209*b* may be positioned between the elastomeric sealing element 114*a* and 114*b* and the expandable metal sealing element 104. A sealing region 412 of the swell packer 402 may include the elastomeric sealing elements 114*a* and 114*b*, the expandable metal sealing element 104, and the element support rings 209*a* and 209*b*. While FIGS. 2-4 show three examples of configurations of the swell packer 102, it should be appreciated that any suitable configuration of the swell packer 102 can be used for forming the long-term seal with the expandable metal sealing element 104 in the wellbore 106.

Figure 5:
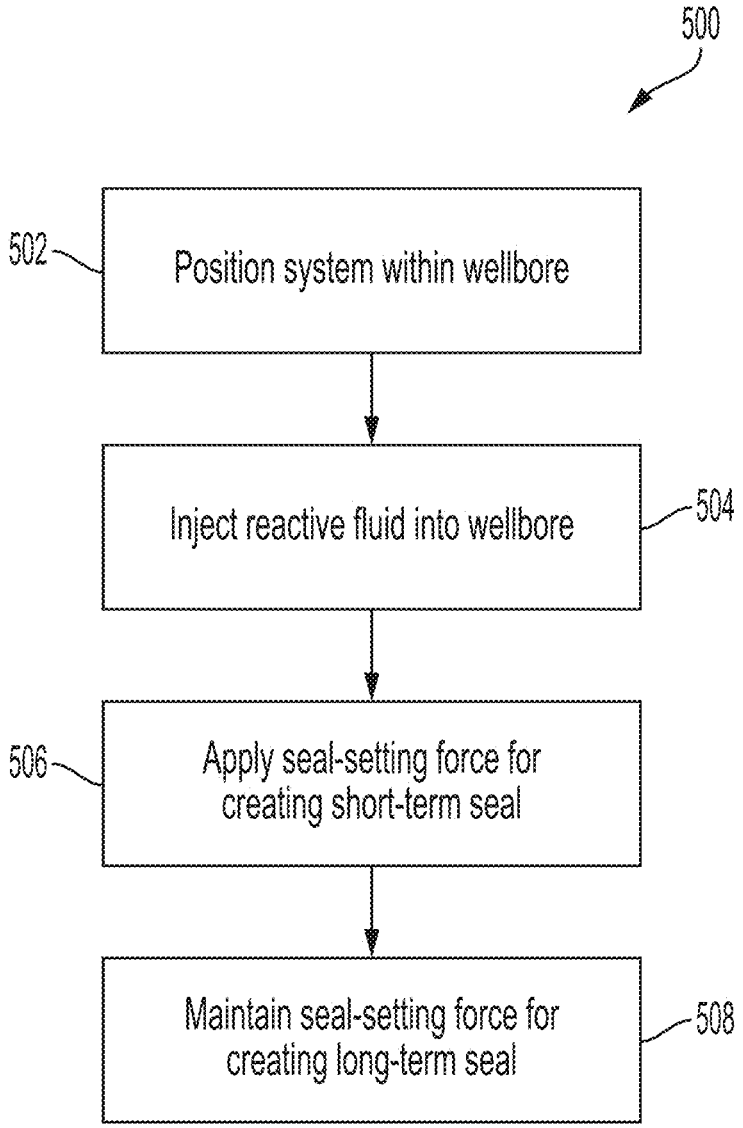
FIG. 5 is a flow chart of a process for forming a long-term seal in a wellbore using the swell packer of FIG. 1 according to one example of the present disclosure.

FIG. 5 is a flow chart of a process 500 for forming the long-term seal in the wellbore 106, according to one example of the present disclosure. At block 502, the process involves positioning the swell packer 102 in the wellbore 106 for forming the long-term seal. The swell packer 102 may include the mandrel 210, the setting piston 202, the expandable metal sealing element 104, and the elastomeric sealing element 114. The swell packer 102 may include any other suitable components for forming the long-term seal in the wellbore 106. An operator of the wellbore 106 may deploy or otherwise position the swell packer 102 in the wellbore 106 at a desired depth. In some examples, the swell packer 102 may include more than one expandable metal sealing element 104, more than one elastomeric sealing element 114, more than one setting piston 202, or a combination thereof.

At block 504, the process 500 involves injecting a reactive fluid into the wellbore 106. The reactive fluid may be a brine that reacts with the expandable metal sealing element 104 to cause the expandable metal material to swell by undergoing a hydrolysis reaction to form metal hydroxides with a greater volume than the expandable metal sealing element 104. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines can include, for example, magnesium chloride brines, calcium chloride brines, calcium bromide brines, and the like. In some examples, the salinity of the brine may exceed 10%.

At block 506, the process 500 involves applying the seal-setting force for creating the short-term seal. The setting piston 202 may apply the seal-setting force on the elastomeric sealing element 114. The seal-setting force applied to the elastomeric sealing element 114 may cause the elastomeric sealing element 114 to expand radially outward from the mandrel 110 to create the short-term seal in the wellbore 106 between the mandrel 110 and the wall 108 of the wellbore 106. During the application and retention of the seal-setting force, the elastomeric sealing element 114 may not extrude. The setting chamber 204 may engage or otherwise cause the setting piston 202 to apply the seal-setting force on the elastomeric sealing element 114. In some examples, the seal-setting force is maintained for a predetermined amount of time by the setting piston 202. In other examples, the seal-setting force is retained by the body lock rings 206 positioned on the swell packer 102. The body lock rings 206 may enable the setting piston 202 to release the seal-setting force once the seal-setting force is retained by the body lock rings 206. The predetermined amount of time may be any suitable amount of time for forming the long-term seal.

In an example, the short-term seal generated by the elastomeric sealing element 114 may prevent crossflow of the brine or other well fluid across the expandable metal material of the expandable metal sealing element 104 during the swelling reaction. This reduction in crossflow may limit loose particles from the expandable metal sealing element 104 from being flushed downhole within the wellbore 106. In an example with multiple elastomeric sealing elements 114, the brine may be trapped between the elastomeric sealing elements 114 to maintain the brine in contact with the expandable metal sealing element 104 during the hydrolysis reaction.

At block 506, the process 500 involves maintaining the seal-setting force for forming the long-term seal. In response to applying the seal-setting force and forming the short-term seal, the swell packer 102 may form the long-term seal. The seal-setting force may be maintained by the setting piston 202 or the body lock rings 206 for the predetermined amount of time. During the predetermined amount of time, the expandable metal sealing element 104 may undergo a hydrolysis reaction followed by a dehydration reaction, both of which may involve alkaline earth metals, transition metals, or both. The reactions may cause the expandable metal sealing element 104 to form the long-term seal. The long-term seal may persist for the life of the wellbore operations, or, in some examples, the long-term seal may be permanent. In response to forming the long-term seal, the swell packer may remove the seal-setting force by disengaging the setting piston 202 or by disengaging the body lock rings 206.

In some aspects, systems, and methods for swellable metal elements combined with elastomeric seals are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a wellbore packer system comprising: a mandrel positionable within a wellbore; and a wellbore packer positionable around the mandrel, the wellbore packer comprising: an expandable metal sealing element positionable around a first portion of the mandrel to form a long-term seal within the wellbore in response to exposure of the expandable metal sealing element to wellbore fluid; an elastomeric sealing element positionable around a second portion of the mandrel to form a short-term seal within the wellbore in response to receiving a seal-setting force; and a setting piston positionable to apply the seal-setting force on the elastomeric sealing element.

Example 2 is the wellbore packer system of example 1, wherein the long-term seal is formable using a hydrolysis reaction of an alkaline earth metal or a transition metal of the expandable metal sealing element.

Example 3 is the wellbore packer system of examples 1-2, further comprising: a setting cylinder positionable to form a setting chamber between the setting cylinder and the mandrel, wherein the setting chamber is positionable to transfer the seal-setting force to the setting piston as a pressure within the setting chamber increases.

Example 4 is the wellbore packer system of examples 1-3, further comprising: a second elastomeric sealing element, wherein the second elastomeric sealing element is positionable around a third portion of the mandrel, and wherein the expandable metal sealing element is positionable between the elastomeric sealing element and the second elastomeric sealing element.

Example 5 is the wellbore packer system of any of examples 1-4, further comprising: a second setting piston positionable to apply a second seal-setting force on the second elastomeric sealing element; and a set screw positionable on the expandable metal sealing element to maintain the expandable metal sealing element in a set position with respect to the mandrel.

Example 6 is the wellbore packer system of examples 1-5, further comprising at least one body lock ring positionable to retain the seal-setting force on the elastomeric sealing element while the expandable metal sealing element forms the long-term seal.

Example 7 is the wellbore packer system of examples 1-6, wherein the elastomeric sealing element is positionable to generate a 2000-5000 PSI seal.

Example 8 is a method comprising: positioning a wellbore packer system comprising an expandable metal sealing element and an elastomeric sealing element within a wellbore; applying, by the wellbore packer system, a seal-setting force to the elastomeric sealing element of the wellbore packer system to generate a short-term seal; and maintaining, by the wellbore packer system, the seal-setting force for a predetermined amount of time to generate a long-term seal from the expandable metal sealing element of the wellbore packer system.

Example 9 is the method of example 8, wherein the long-term seal is formable using a hydrolysis reaction and a subsequent dehydration reaction, wherein the hydrolysis reaction and the subsequent dehydration reaction involve an alkaline earth metal or a transition metal of the expandable metal sealing element.

Example 10 is the method of examples 8-9, further comprising: injecting a brine into the wellbore upon positioning the wellbore packer system within the wellbore, wherein the brine is reactive with the expandable metal sealing element to generate a hydrolysis reaction that forms the long-term seal.

Example 11 is the method of examples 8-10, wherein the wellbore packer system comprises a second elastomeric sealing element on a side of the expandable metal sealing element opposite the elastomeric sealing element, and wherein the seal-setting force is further applied to the second elastomeric sealing element to generate a second short-term seal.

Example 12 is the method of examples 8-11, wherein the seal-setting force is applied to the elastomeric sealing element by a setting piston, and wherein the setting piston is activated by pressure generated in a setting chamber from fluid received within a mandrel of the wellbore packer system from a surface of the wellbore.

Example 13 is the method of examples 8-12, wherein maintaining the seal-setting force comprises moving, by the seal-setting force, a body lock ring to a short-term seal position that maintains the short-term seal of the elastomeric sealing element.

Example 14 is the method of examples 8-13, wherein the wellbore packer system comprises a second expandable metal sealing element positioned on an opposite side of the elastomeric sealing element from the expandable metal sealing element, and wherein applying the seal-setting force to the elastomeric sealing element generates the short-term seal between the expandable metal sealing element and the second expandable metal sealing element.

Example 15 is the method of examples 8-14, further comprising: releasing the seal-setting force applied by a setting piston upon moving a body lock ring to a short-term seal position that maintains the short-term seal of the elastomeric sealing element.

Example 16 is a packer comprising: an expandable metal sealing element positionable around a first portion of a mandrel to form a long-term seal within a wellbore in response to exposure of the expandable metal sealing element to wellbore fluid; and an elastomeric sealing element positionable around a second portion of the mandrel to form a short-term seal within the wellbore in response to receiving a seal-setting force.

Example 17 is the packer of example 16, wherein the long-term seal is formable using a hydrolysis reaction of an alkaline earth metal or a transition metal of the expandable metal sealing element.

Example 18 is the packer of examples 16-17, further comprising: a second elastomeric sealing element positionable around a third portion of the mandrel to form a second short-term seal in response to receiving the seal-setting force, wherein the second elastomeric sealing element is positionable on a side opposite the expandable metal sealing element from the elastomeric sealing element; a setting piston positionable to apply the seal-setting force to the elastomeric sealing element and the second elastomeric sealing element; a body lock ring positionable to maintain the seal-setting force on the elastomeric sealing element; and a second body lock ring positionable to maintain the seal-setting force on the second elastomeric sealing element.

Example 19 is the packer of examples 16-18, further comprising: a second expandable metal sealing element positionable around a third portion of the mandrel, wherein the elastomeric sealing element is positionable between the expandable metal sealing element and the second expandable metal sealing element.

Example 20 is the packer of examples 16-19, wherein the expandable metal sealing element comprises a metal, or metal alloy comprising the metal, selected from a group consisting of magnesium, calcium, aluminum, or any combination thereof.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A wellbore packer system comprising:

a mandrel positionable within a wellbore; and a wellbore packer positionable around the mandrel, the wellbore packer comprising:

an expandable metal sealing element positionable around a first portion of the mandrel to form a long-term seal within the wellbore in response to exposure of the expandable metal sealing element to wellbore fluid;

an elastomeric sealing element positionable around a second portion of the mandrel to form a short-term seal within the wellbore in response to receiving a seal-setting force;

a support ring positionable around a third portion of the mandrel between the expandable metal sealing element and the elastomeric sealing element to provide temperature isolation to the elastomeric sealing element; and a setting piston positionable to apply the seal-setting force on the elastomeric sealing element.

2. The wellbore packer system of claim 1, wherein the long-term seal is formable using a hydrolysis reaction of an alkaline earth metal or a transition metal of the expandable metal sealing element.

3. The wellbore packer system of claim 1, further comprising:

a setting cylinder positionable to form a setting chamber between the setting cylinder and the mandrel, wherein the setting chamber is positionable to transfer the seal-setting force to the setting piston as a pressure within the setting chamber increases.

4. The wellbore packer system of claim 1, further comprising:

a second elastomeric sealing element, wherein the second elastomeric sealing element is positionable around a third portion of the mandrel, and wherein the expandable metal sealing element is positionable between the elastomeric sealing element and the second elastomeric sealing element.

5. The wellbore packer system of claim 4, further comprising:

a second setting piston positionable to apply a second seal-setting force on the second elastomeric sealing element; and a set screw positionable on the expandable metal sealing element to maintain the expandable metal sealing element in a set position with respect to the mandrel.

6. The wellbore packer system of claim 1, further comprising at least one body lock ring positionable to retain the seal-setting force on the elastomeric sealing element while the expandable metal sealing element forms the long-term seal.

7. The wellbore packer system of claim 1, wherein the elastomeric sealing element is positionable to generate a 2000-5000 PSI seal.

8. A method comprising:

positioning a wellbore packer system within a wellbore, the wellbore packer system comprising:

an expandable metal sealing element positioned around a first portion of a mandrel of the wellbore packer system;

an elastomeric sealing element positioned around a second portion of the mandrel; and a support ring positioned around a third portion of the mandrel between the expandable metal sealing element and the elastomeric sealing element to provide temperature isolation to the elastomeric sealing element;

applying, by the wellbore packer system, a seal-setting force to the elastomeric sealing element of the wellbore packer system to generate a short-term seal; and maintaining, by the wellbore packer system, the seal-setting force for a predetermined amount of time to generate a long-term seal from the expandable metal sealing element of the wellbore packer system.

9. The method of claim 8, wherein the long-term seal is formable using a hydrolysis reaction and a subsequent dehydration reaction, wherein the hydrolysis reaction and the subsequent dehydration reaction involve an alkaline earth metal or a transition metal of the expandable metal sealing element.

10. The method of claim 8, further comprising:

injecting a brine into the wellbore upon positioning the wellbore packer system within the wellbore, wherein the brine is reactive with the expandable metal sealing element to generate a hydrolysis reaction that forms the long-term seal.

11. The method of claim 8, wherein the wellbore packer system comprises a second elastomeric sealing element on a side of the expandable metal sealing element opposite the elastomeric sealing element, and wherein the seal-setting force is further applied to the second elastomeric sealing element to generate a second short-term seal.

12. The method of claim 8, wherein the seal-setting force is applied to the elastomeric sealing element by a setting piston, and wherein the setting piston is activated by pressure generated in a setting chamber from fluid received within a mandrel of the wellbore packer system from a surface of the wellbore.

13. The method of claim 8, wherein maintaining the seal-setting force comprises moving, by the seal-setting force, a body lock ring to a short-term seal position that maintains the short-term seal of the elastomeric sealing element.

14. The method of claim 8, wherein the wellbore packer system comprises a second expandable metal sealing element positioned on an opposite side of the elastomeric sealing element from the expandable metal sealing element, and wherein applying the seal-setting force to the elastomeric sealing element generates the short-term seal between the expandable metal sealing element and the second expandable metal sealing element.

15. The method of claim 8, further comprising:

releasing the seal-setting force applied by a setting piston upon moving a body lock ring to a short-term seal position that maintains the short-term seal of the elastomeric sealing element.

16. A packer comprising:

an expandable metal sealing element positionable around a first portion of a mandrel to form a long-term seal within a wellbore in response to exposure of the expandable metal sealing element to wellbore fluid;

an elastomeric sealing element positionable around a second portion of the mandrel to form a short-term seal within the wellbore in response to receiving a seal-setting force; and a support ring positionable around a third portion of the mandrel between the expandable metal sealing element and the elastomeric sealing element to provide temperature isolation to the elastomeric sealing element.

17. The packer of claim 16, wherein the long-term seal is formable using a hydrolysis reaction of an alkaline earth metal or a transition metal of the expandable metal sealing element.

18. The packer of claim 16, further comprising:

a second elastomeric sealing element positionable around a third portion of the mandrel to form a second short-term seal in response to receiving the seal-setting force, wherein the second elastomeric sealing element is positionable on a side opposite the expandable metal sealing element from the elastomeric sealing element;

a setting piston positionable to apply the seal-setting force to the elastomeric sealing element and the second elastomeric sealing element;

a body lock ring positionable to maintain the seal-setting force on the elastomeric sealing element; and a second body lock ring positionable to maintain the seal-setting force on the second elastomeric sealing element.

19. The packer of claim 16, further comprising:

a second expandable metal sealing element positionable around a third portion of the mandrel, wherein the elastomeric sealing element is positionable between the expandable metal sealing element and the second expandable metal sealing element.

20. The packer of claim 16, wherein the expandable metal sealing element comprises a metal, or metal alloy comprising the metal, selected from a group consisting of magnesium, calcium, aluminum, or any combination thereof.

* * * * *